US008589173B2

(12) United States Patent
Sung et al.

(10) Patent No.: US 8,589,173 B2
(45) Date of Patent: Nov. 19, 2013

(54) METHOD AND APPARATUS FOR ENCODING/DECODING SPEECH SIGNAL USING CODING MODE

(75) Inventors: Ho Sang Sung, Yongin-si (KR); Ki Hyun Choo, Seoul (KR); Jung Hoe Kim, Hwaseong-si (KR); Eun Mi Oh, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 949 days.

(21) Appl. No.: 12/591,949

(22) Filed: Dec. 4, 2009

(65) Prior Publication Data

US 2010/0145688 A1 Jun. 10, 2010

(30) Foreign Application Priority Data

Dec. 5, 2008 (KR) ..... 10-2008-0123241

(51) Int. Cl.
*G10L 19/00* (2013.01)

(52) U.S. Cl.
USPC ..... 704/500; 704/219; 704/229; 381/22; 381/23

(58) Field of Classification Search
USPC ..... 704/219, 229, 500; 381/22, 23
See application file for complete search history.

(56) References Cited

U.S. PATENT DOCUMENTS

| | | | | |
|---|---|---|---|---|
| 6,240,387 | B1 * | 5/2001 | DeJaco | 704/221 |
| 2005/0177364 | A1 * | 8/2005 | Jelinek | 704/214 |
| 2006/0106600 | A1 * | 5/2006 | Bessette | 704/223 |
| 2011/0202355 | A1 * | 8/2011 | Grill et al. | 704/500 |

* cited by examiner

*Primary Examiner* — Daniel D Abebe
(74) *Attorney, Agent, or Firm* — Staas & Halsey LLP

(57) ABSTRACT

An apparatus and a method to encode and decode a speech signal using an encoding mode are provided. An encoding apparatus may select an encoding mode of a frame included in an input speech signal, and encode a frame having an unvoiced mode for an unvoiced speech as the selected encoding mode.

20 Claims, 13 Drawing Sheets

FIG. 4

410

| One Superframe = 4 frames | | | |
|---|---|---|---|
| acelp_core_mode : 3 bits | | | |
| Lpd_mode : 5 bits | | | |
| VBR flag : 1 bit | | | |
| VBR mode : 1.5 * 4 = 6 bits | | | |
| 1st frame (Silence, Unvoiced, ACELP, or TCX) | 2nd frame (Silence, Unvoiced, ACELP, or TCX) | 3rd frame (Silence, Unvoiced, ACELP, or TCX) | 4th frame (Silence, Unvoiced, ACELP, or TCX) |
| LPC : 46 ~ 230 bits | | | |

420

| One Superframe = 4 frames | | | |
|---|---|---|---|
| acelp_core_mode : 3 bits | | | |
| Lpd_mode : 5 bits | | | |
| VBR flag : 1 bit | | | |
| 1st frame ACELP, or TCX) | 2nd frame ACELP, or TCX) | 3rd frame ACELP, or TCX) | 4th frame ACELP, or TCX) |
| LPC : 46 ~ 230 bits | | | |

FIG. 5

510

| Syntax | No. of bits | Mnemonic |
|---|---|---|
| lpd_channel_stream() | | |
| { | | |
| acelp_core_mode | 3 | uimsbf |
| lpd_mode | 5 | uimsbf, Note 1 |
| VBR_flag | 1 | |
| if(VBR_flag==1){ | | |
| VBR_mode_index | 6,7,or 8 | |
| } | | |
| first_tcx_flag=TRUE; | | |
| k = 0; | | |
| if (first_lpd_flag) { last_lpd_mode = 0; } | | Note2 |
| while (k < 4) { | | |
| if (mod[k] == 0) { | | |
| if(VBR_flag==1){ | | |
| if(VBR_mode[k]==0) {silence_coding(); } | | |
| else if(VBR_mode[k]==1) {unvoiced_coding(); } | | |
| else {acelp_coding(); } | | |
| }else{ | | |
| acelp_coding(acelp_core_mode); | | |
| } | | |
| last_lpd_mode=0; | | |
| k += 1; | | |
| } | | |
| else { | | |
| tcx_coding( lg(mod[k], last_lpd_mode) , first_tcx_flag); | | Note3 |
| last_lpd_mode=mod[k]; | | |
| k += 2^(mod[k]-1); | | |
| first_tcx_flag=FALSE; | | |
| } | | |
| } | | |
| lpc_data(first_lpd_flag) | | |
| } | | |

511

512

FIG. 6

610

| One Superframe = 4 frames | | | |
|---|---|---|---|
| Lpd_mode : 5 bits | | | |
| VBR flag : 1 bit | | | |
| acelp_core_mode : 2 bits*4 = 8bits | | | |
| 1st frame (Silence, Unvoiced, ACELP, or TCX) | 2nd frame (Silence, Unvoiced, ACELP, or TCX) | 3rd frame (Silence, Unvoiced, ACELP, or TCX) | 4th frame (Silence, Unvoiced, ACELP, or TCX) |
| LPC : 46 ~ 230 bits | | | |

620

| One Superframe = 4 frames | | | |
|---|---|---|---|
| Lpd_mode : 5 bits | | | |
| VBR flag : 1 bit | | | |
| acelp_core_mode : 2 bits | | | |
| 1st frame ACELP, or TCX) | 2nd frame ACELP, or TCX) | 3rd frame ACELP, or TCX) | 4th frame ACELP, or TCX) |
| LPC : 46 ~ 230 bits | | | |

FIG. 7

710

| One Superframe = 4 frames | | | |
|---|---|---|---|
| acelp_core_mode : 3 bits(0~6, 7=UV) | | | |
| Lpd_mode : 5 bits | | | |
| Real acelp_core_mode : 3 bits | | | |
| UV mode : 2 * 4 = 8 bits | | | |
| 1st frame (Silence, Unvoiced, ACELP, or TCX) | 2nd frame (Silence, Unvoiced, ACELP, or TCX) | 3rd frame (Silence, Unvoiced, ACELP, or TCX) | 4th frame (Silence, Unvoiced, ACELP, or TCX) |
| LPC : 46 ~ 230 bits | | | |

720

| One Superframe = 4 frames | | | |
|---|---|---|---|
| acelp_core_mode : 3 bits (0~6, 7=UV) | | | |
| Lpd_mode : 5 bits | | | |
| 1st frame ACELP, or TCX) | 2nd frame ACELP, or TCX) | 3rd frame ACELP, or TCX) | 4th frame ACELP, or TCX) |
| LPC : 46 ~ 230 bits | | | |

FIG. 10

1010

| One Superframe = 4 frames | | | |
|---|---|---|---|
| acelp_core_mode : 3 bits | | | |
| Lpd_mode : 5 bits | | | |
| VBR Flag : 1 bit | | | |
| UV mode : 2*4 = 8 bits | | | |
| 1st frame (Silence, Unvoiced, ACELP, or TCX) | 2nd frame (Silence, Unvoiced, ACELP, or TCX) | 3rd frame (Silence, Unvoiced, ACELP, or TCX) | 4th frame (Silence, Unvoiced, ACELP, or TCX) |
| LPC : 46 ~ 230 bits | | | |

1020

| One Superframe = 4 frames | | | |
|---|---|---|---|
| acelp_core_mode : 3 bits | | | |
| Lpd_mode : 5 bits | | | |
| VBR Flag : 1 bit | | | |
| 1st frame (Silence, Unvoiced, ACELP, or TCX) | 2nd frame (Silence, Unvoiced, ACELP, or TCX) | 3rd frame (Silence, Unvoiced, ACELP, or TCX) | 4th frame (Silence, Unvoiced, ACELP, or TCX) |
| LPC : 46 ~ 230 bits | | | |

FIG. 11

1110

| Syntax | No. of bits | Mnemonic |
|---|---|---|
| lpd_channel_stream() | | |
| { | | |
| acelp_core_mode | 3 | uimsbf |
| lpd_mode | 5 | uimsbf, Note 1 |
| VBR_flag | 1 | |
| if(VBR_flag==1){ | | |
| if(no_of_TCX == 0) {VBR_mode_index} | 8 | |
| else if(no_of_TCX == 1) {VBR_mode_index} 1111 | 6 | |
| else if(no_of_TCX == 2) {VBR_mode_index} | 4 | |
| else if(no_of_TCX == 3) {VBR_mode_index} | 2 | |
| } | | |
| first_tcx_flag=TRUE; | | |
| k = 0; | | |
| if (first_lpd_flag) { last_lpd_mode = 0; } | | Note 2 |
| while (k < 4) { | | |
| if (mod[k] == 0) { | | |
| if(VBR_flag==1){ | | |
| if(VBR_mode[k]==0) {silence_coding(); } | | |
| else if(VBR_mode[k]==1) {unvoiced_coding(); } | | |
| else {acelp_coding(); } 1112 | | |
| }else{ | | |
| acelp_coding(acelp_core_mode); | | |
| } | | |
| last_lpd_mode=0; | | |
| k += 1; | | |
| } | | |
| else { | | |
| tcx_coding( lg(mod[k], last_lpd_mode) , first_tcx_flag); | | Note 3 |
| last_lpd_mode=mod[k]; | | |
| k += 2^(mod[k]-1); | | |
| first_tcx_flag=FALSE; | | |
| } | | |
| } | | |
| lpc_data(first_lpd_flag) | | |
| } | | |

METHOD AND APPARATUS FOR ENCODING/DECODING SPEECH SIGNAL USING CODING MODE

CROSS-REFERENCE TO RELATED APPLICATIONS

This application claims the benefit of Korean Patent Application No. 10-2008-0123241, filed on Dec. 5, 2008, in the Korean Intellectual Property Office, the disclosure of which is incorporated herein by reference.

BACKGROUND

1. Field

One or more embodiments of the present application relate to an apparatus and method to encode and decode a speech signal using an encoding mode.

2. Description of the Related Art

A speech coder typically refers to a device that uses a technology to extract parameters associated with a mode of a human speech generation to compress a speech. The speech coder may divide a speech signal into time blocks or analysis frames. Generally, the speech coder may include an encoder and a decoder. The encoder may extract parameters to analyze an input speech frame, and may quantize the parameters to be represented as, for example, a set of bits or a binary number such as a binary data packet. Data packets may be transmitted to a receiver and the decoder via a communication channel. The decoder may process the data packets and quantize the data to generate the parameters, and may re-combine a speech frame using the unquantized parameters.

SUMMARY

Proposed are an encoding apparatus, a decoding apparatus, and an encoding method that may more effectively encode a signal and decode the encoded signal in a superframe structure.

One or more embodiments of the present application may provide an encoding apparatus and method that may encode a frame that includes an unvoiced speech, using an unvoiced mode in a superframe structure.

One or more embodiments of the present application may also provide an encoding apparatus and method that may determine an encoding mode of each frame, classified into an unvoiced speech, a voiced speech, a silence, and a background noise, as an unvoiced mode, at least one voiced mode of a different bitrate, a silence mode, and at least one Transform Coded eXcitation (TCX) mode of a different bitrate, and may encode each of the frames at a different bitrate using an encoder corresponding to each determined mode.

One or more embodiments of the present application may also provide a decoding apparatus that may decode frames that are encoded at different bitrates according to encoding modes of the frames.

Additional aspects and/or advantages will be set forth in part in the description which follows and, in part, will be apparent from the description, or may be learned by practice of the embodiments.

According to an aspect of one or more embodiments, there may be provided an encoding apparatus including: a mode selection unit to select an encoding mode of a frame that is included in an input speech signal; and an unvoiced mode encoder to encode a frame having an unvoiced mode for an unvoiced speech as the selected encoding mode.

When none of the unvoiced speech and a silence is detected in a superframe including a plurality of frames, the mode selection unit may select the same encoding mode for all the frames included in the superframe. When at least one of the unvoiced speech and the silence is detected in the superframe, the mode selection unit may individually select the encoding mode for each of the frames included in the superframe.

A predetermined flag may be inserted into the superframe to indicate whether at least one of the unvoiced speech and the silence is included in the superframe.

The encoding mode of each of the frames included in the superframe may be determined based on the predetermined flag and an Algebraic Code Excited Linear Prediction (ACELP) core mode that indicates a common encoding mode of all the frames included in the superframe. Also, the encoding mode of each of the frames included in the superframe may be determined based on the predetermined flag and an index where an enumeration is applied with respect to an encoding mode for outputting for each of the frames included in the superframe.

The encoding mode may include the unvoiced mode, a silence mode for the silence, and a voiced mode for a voiced speech and a background noise, and a TCX mode. The encoding apparatus may further include: a voiced mode encoder to encode a frame having the voiced mode as the selected encoding mode; a silence mode encoder to encode a frame having the silence mode as the selected encoding mode; and a TCX encoder to encode a frame having the TCX mode as the selected encoding mode.

Here, the encoding mode for the frame of the unvoiced mode and the frame of the silence mode may be selected using an open-loop scheme. The encoding mode for the frame of the voiced mode and the frame of the TCX mode may be selected using a closed-loop scheme.

The encoding apparatus may further include: a voice activity detection unit to transmit, to the mode selection unit, information that is obtained by analyzing a characteristic of the speech signal and detecting a voice activity; and an open-loop pitch search unit to retrieve an open-loop pitch and to transmit the open-loop pitch to the mode selection unit. The mode selection unit may determine a property of a current frame based on information that is transmitted from the voice activity detection unit and the open-loop pitch search unit to select the encoding mode of the frame as one of a TCX mode, a voiced mode, the unvoiced mode, and a silence mode, based on the property of the current frame. The TCX mode may include a plurality of modes that are pre-determined based on a frame size.

According to another aspect of one or more embodiments, there may be provided a decoding apparatus including: an encoding mode verification unit to verify an encoding mode of a frame in an input bitstream; and an unvoiced mode decoder to decode a frame having an unvoiced mode for an unvoiced speech as the selected encoding mode. The encoding mode may include the unvoiced mode, a silence mode for a silence, a voiced mode for a voiced speech and a background noise, and a TCX mode. The decoding apparatus may further include: a voiced mode decoder to decode a frame having the voiced mode as the selected encoding mode; a silence mode decoder to decode a frame having the silence mode as the selected encoding mode; and a TCX mode decoder to decode a frame having the TCX mode as the selected encoding mode.

BRIEF DESCRIPTION OF THE DRAWINGS

These and/or other aspects and advantages will become apparent and more readily appreciated from the following description of the exemplary embodiments, taken in conjunction with the accompanying drawings of which:

FIG. 4 illustrates tables for describing a syntax structure according to another exemplary embodiment;

FIG. 5 illustrates an example of a syntax according to FIG. 4;

FIG. 6 illustrates tables for describing a syntax structure according to still another exemplary embodiment;

FIG. 7 illustrates tables for describing a syntax structure according to yet another exemplary embodiment;

FIG. 10 illustrates tables for describing a syntax structure according to another exemplary embodiment;

FIG. 11 illustrates an example of a syntax regarding a method to determine an encoding mode in interoperation with 'Ipd_mode' according to an exemplary embodiment;

DETAILED DESCRIPTION OF EMBODIMENTS

Figure 1:
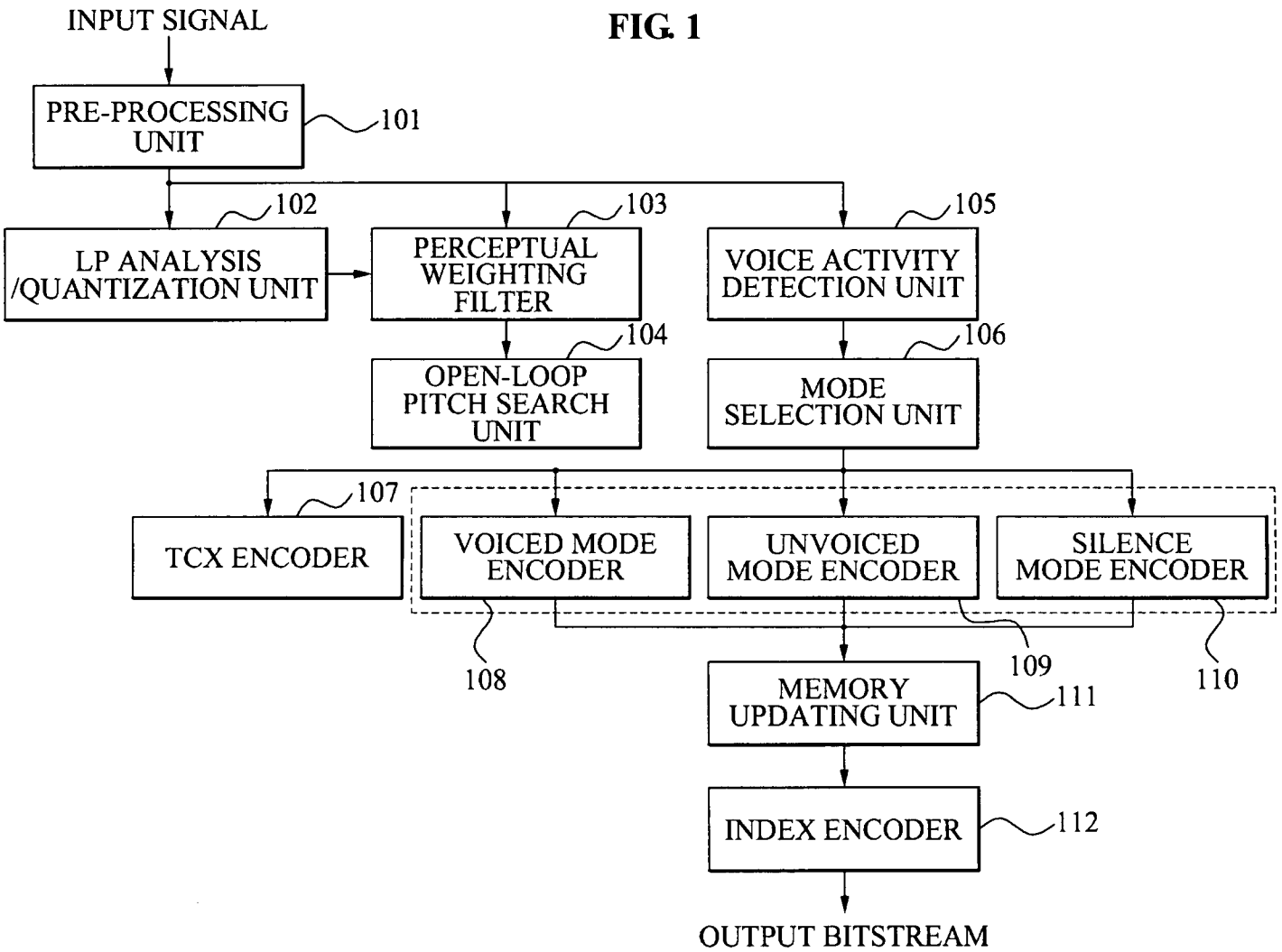
FIG. 1 illustrates a block diagram of an internal configuration of an encoding apparatus according to an exemplary embodiment.

Reference will now be made in detail to exemplary embodiments, examples of which are illustrated in the accompanying drawings, wherein like reference numerals refer to like elements throughout. Exemplary embodiments are described below to explain the present disclosure by referring to the figures.

FIG. 1 illustrates a block diagram of an internal configuration of an encoding apparatus according to an exemplary embodiment. Referring to FIG. 1, the encoding apparatus may include a pre-processing unit 101, a linear prediction (LP) analysis/quantization unit 102, a perceptual weighting filter unit 103, an open-loop pitch search unit 104, a voice activity detection unit 105, a mode selection unit 106, a Transform Coded eXcitation (TCX) encoder 107, a voiced mode encoder 108, an unvoiced mode encoder 109, a silence mode encoder 110, a memory updating unit 111, and an index encoder 112.

A single superframe may include four frames. The single superframe may be encoded by encoding the four frames. For example, when a single superframe includes 1024 samples, each of the four frames may include 256 samples. Here, the frames may overlap each other to generate different frame sizes through an overlap and add (OLA) process.

The TCX encoder 107 may include three modes. The three modes may be classified based on a frame size. For example, a TCX mode may include three modes that have a basic size of 256 samples, 512 samples, and 1024 samples, respectively.

The voiced mode encoder 108, the unvoiced mode encoder 109, and the silence mode encoder 110 may be classified by a Code-Excited Linear Prediction (CELP) encoder (not shown). All the frames used in the CELP encoder may have a basic size of 256 samples.

The pre-processing unit 101 may eliminate an undesired frequency component in an input signal and may adjust a frequency characteristic to be suitable for an encoding through a pre-filtering operation. The pre-processing unit 101 may use, for example, a pre-emphasis filtering of adaptive multi-rate wideband (AMR-WB). The input signal may have a sampling frequency set to be suitable for the encoding. For example, the input signal may have a sampling frequency of 8000 Hz in a narrowband speech encoder, and may have a sampling frequency of 16000 Hz in a wideband speech encoder. The input signal may have any sampling frequency that may be supported in the encoding apparatus. Here, downsampling may occur outside the pre-processing unit 101 and 12800 Hz may be used for an internal sampling frequency. The input signal filtered via the pre-processing unit 101 may be input into the LP analysis/quantization unit 102.

The LP analysis/quantization unit 102 may extract an LP coefficient using the filtered input signal. The LP analysis/quantization unit 102 may convert the LP coefficient to a form suitable for quantization, for example, to an immittance spectral frequencies (ISF) coefficient or a line spectral frequencies (LSF) frequency, and subsequently quantize the converted coefficient using various types of quantization schemes, for example, a vector quantizer. A quantization index determined through the coefficient quantization may be transmitted to the index encoder 112. The extracted LP coefficient and the quantized LP coefficient may be transmitted to the perceptual weighting filter unit 103.

The perceptual weighting filter unit 103 may filter the pre-processed signal via a cognitive weighted filter. The perceptual weighting filter unit 103 may decrease quantization noise to be within a masking range in order to utilize a masking effect associated with a human hearing configuration. The signal filtered via the perceptual weighting filter unit 103 may be transmitted to the open-loop pitch search unit 104.

The open-loop pitch search unit 104 may search for an open-loop pitch using the transmitted filtered signal.

The voice activity detection unit 105 may receive the signal that is filtered via the pre-processing unit 101, analyze a characteristic of the filtered signal, and detect a voice activity. As an example of such a characteristic of the input signal, tilt information of a frequency domain, energy of each bark band, and the like may be analyzed. Information obtained from the open-loop pitch retrieved from the open-loop pitch search unit 104 and the voice activity detection unit 105 may be transmitted to the mode selection unit 106.

The mode selection unit 106 may select an encoding mode of a frame based on information received from the open-loop pitch search unit 104 and the voice activity detection unit 105. Prior to selecting the encoding mode, the mode selection unit 106 may determine a property of a current frame. For example, the mode selection unit 106 may classify the property of the current frame into a voiced speech, an unvoiced speech, a silence, a background noise, and the like, using an unvoiced detection result. The mode selection unit 106 may determine the encoding mode of the current frame based on the classified result. In this instance, the mode selection unit 106 may select, as the encoding mode, one of a TCX mode, a voiced mode for a voiced speech, a background noise having great energy, a voice speech with background noise, and the like, an unvoiced mode, and a silence mode. Here, each of the TCX mode and the voiced mode may include at least one mode that has a different bitrate.

When the TCX mode is selected as the encoding mode, the encoding mode having a size of any of 256 samples, 512 samples, and 1024 samples may be used. A total of six modes including the voiced mode, the unvoiced mode, and the silence mode may be used. Also, various types of schemes may be used to select the encoding mode.

Initially, the encoding mode may be selected using an open-loop scheme. The open-loop scheme may accurately determine a signal characteristic of a current interval using a module that verifies a characteristic of a signal, and may select the encoding mode most suitable for the signal. For example, when an interval of a current input signal is determined as a silence interval, the current input signal may be encoded via the silence mode encoder 110 using the silence mode. When the interval of the current input signal is determined as an unvoiced interval, the current input signal may be encoded via the unvoiced mode encoder 109 using the unvoiced mode. Also, when the interval of the current input signal is determined as a voiced interval with background noise less than a given threshold or as a voice interval without background noise, the current input signal may be encoded via the voiced mode encoder 108 using the voiced mode. In other cases, the current input signal may be encoded via the TCX encoder 107 using the TCX mode.

Secondly, the encoding mode may be selected using a closed-loop scheme. The closed-loop scheme may substantially encode the current input signal and select a most effective encoding mode using a signal-to-noise ratio (SNR) between the encoded signal and an original input signal, or another measurement value. In this instance, an encoding process may need to be performed with respect to all the available encoding modes. Accordingly, complexity may increase whereas performance may be enhanced. Also, when determining an appropriate encoder based on the SNR, determining whether to use the same bitrate or a different bitrate may become an issue. Since a bit utilization rate is basically different for each of the unvoiced mode encoder 109 and the silence mode encoder 110, the most suitable encoding mode may need to be determined based on the SNR with respect to used bits. In addition, since each encoding scheme is different, a final selection may be made by appropriately applying a weight to each encoding scheme.

Thirdly, the encoding mode may be selected by combining the aforementioned two encoding mode selection schemes. The third scheme may be used when the SNR between the encoded signal and the original input signal is low and the encoded signal frequently sounds similar to an original sound based on the original input signal. Accordingly, by combining the open-loop scheme and the closed-loop scheme, complexity may be decreased and the input signal may be encoded to have excellent sound quality. For example, when the interval of the current input signal is finally determined as a silence interval by searching for a case where the interval of the current input signal corresponds to the silence interval, the current input signal may be encoded using the silence mode encoder 110. When the interval of the current input signal is determined as an unvoiced interval, the current input signal may be encoded using the unvoiced mode encoder 109. Also, when the interval of the current input signal is determined as a background noise interval, the current input signal may be variously classified according to a signal characteristic. For example, when the input signal does not satisfy a criterion for the silence and the voiced speech, the input signal may be classified into the voiced signal and other signals. A background noise signal, a normal voiced signal, a voiced signal with the background noise, and the like may be encoded using the TCX encoder 107 and the voiced mode encoder 108. Specifically, with particular reference to the TCX mode and the voiced mode, the input signal may be encoded using one of the open-loop scheme and the closed-loop scheme. An encoding technology adopting the open-loop scheme or the closed-loop scheme only with respect to the TCX encoder 107 and the voiced mode encoder 108 is well represented in an existing standardized AMR-WB+encoder.

The mode selection unit 106 may also perform a post-processing operation for the selected encoding mode. For example, as one of post-processing schemes, the mode selection unit 106 may assign a constraint to the selected encoding mode. The constraint scheme may eliminate an inappropriate combination of encoding modes that may affect sound quality and thereby enhance the sound quality of a finally encoded signal.

For example, when encoding each frame included in a superframe, a frame of the silence mode or the unvoiced mode may be followed by a single frame of the voiced mode or the TCX mode, which may be subsequently followed by another frame of the silence mode or the unvoiced mode. In this embodiment, the constraint scheme may compulsorily convert the last frame of the silence mode or the unvoiced mode to the frame of the voiced mode or the TCX mode by applying the constraint. When only a single frame of the voiced mode or the TCX mode exists, a mode may be changed even before appropriately performing encoding, which may affect the sound quality. Accordingly, the above constraint scheme may be used to avoid a short frame of the voiced mode or the TCX mode.

As another example of the constraint, there is a scheme that may temporarily correct the encoding mode when converting the encoding mode. For example, when a frame of the silence mode or the unvoiced mode is followed by a frame of the voiced mode or the TCX mode, a value corresponding to the encoding mode may temporarily increase with respect to the followed single frame regardless of 'acelp_core_mode', which will be described later. For example, it is assumed that encodable frame modes exist from mode 1 to mode 7 with respect to the frame of the voiced mode or the TCX mode. When 'acelp_core_mode' representing a mode of a current frame is mode 1 and corresponds to the above criterion, one of the current mode+mode 1 to mode 6 may be selected as a final mode of the current frame.

As still another example of the constraint, there is a scheme that may enable the frame of the silence mode or the unvoiced mode to be activated primarily at a low bitrate. For some embodiments, a sound quality may be more important than a bitrate being greater than a given bitrate. In this case, the third constraint may be minus for the entire sound quality at a very high bitrate. Accordingly, in an embodiment, encoding may be performed using only the frame of the voiced mode or the TCX mode. In this instance, a criterion may be appropriately selected by the developer. For example, when encoding is performed at less than 300 bits per frame including 256 samples, the encoding may be performed using the frame of the silence mode or the unvoiced mode. When encoding is performed at more than 300 bits per frame, the encoding may be performed using only the frame of the voiced mode or the TCX mode.

As still another example of the constraint, there is a scheme that may verify a characteristic of a current frame and spontaneously correct the encoding mode. Specifically, when the current frame is determined as the frame of the voiced mode or the TCX mode, but the current frame has a low periodicity like an onset or a transition, encoding of the frame may affect an after-performance. Accordingly, the current frame may be temporarily encoded at a high bitrate regardless of 'acelp_core_mode'. For example, let frame modes for encoding exist from mode 1 to mode 7 with respect to the frame of the voiced mode or the TCX mode. When 'acelp_core_mode' of the current frame is mode 1 and corresponds to the above criterion, that is, the onset or the transition, one of the current mode+mode 1 to mode 6 may be selected as a final mode of the current frame.

The memory updating unit 111 may update a status of each filter used for encoding. The index encoder 112 may gather transmitted indexes to transform the indexes to a bitstream, and then may store the bitstream in a storage unit (not shown) or may transmit the bitstream via a channel.

Figure 2:
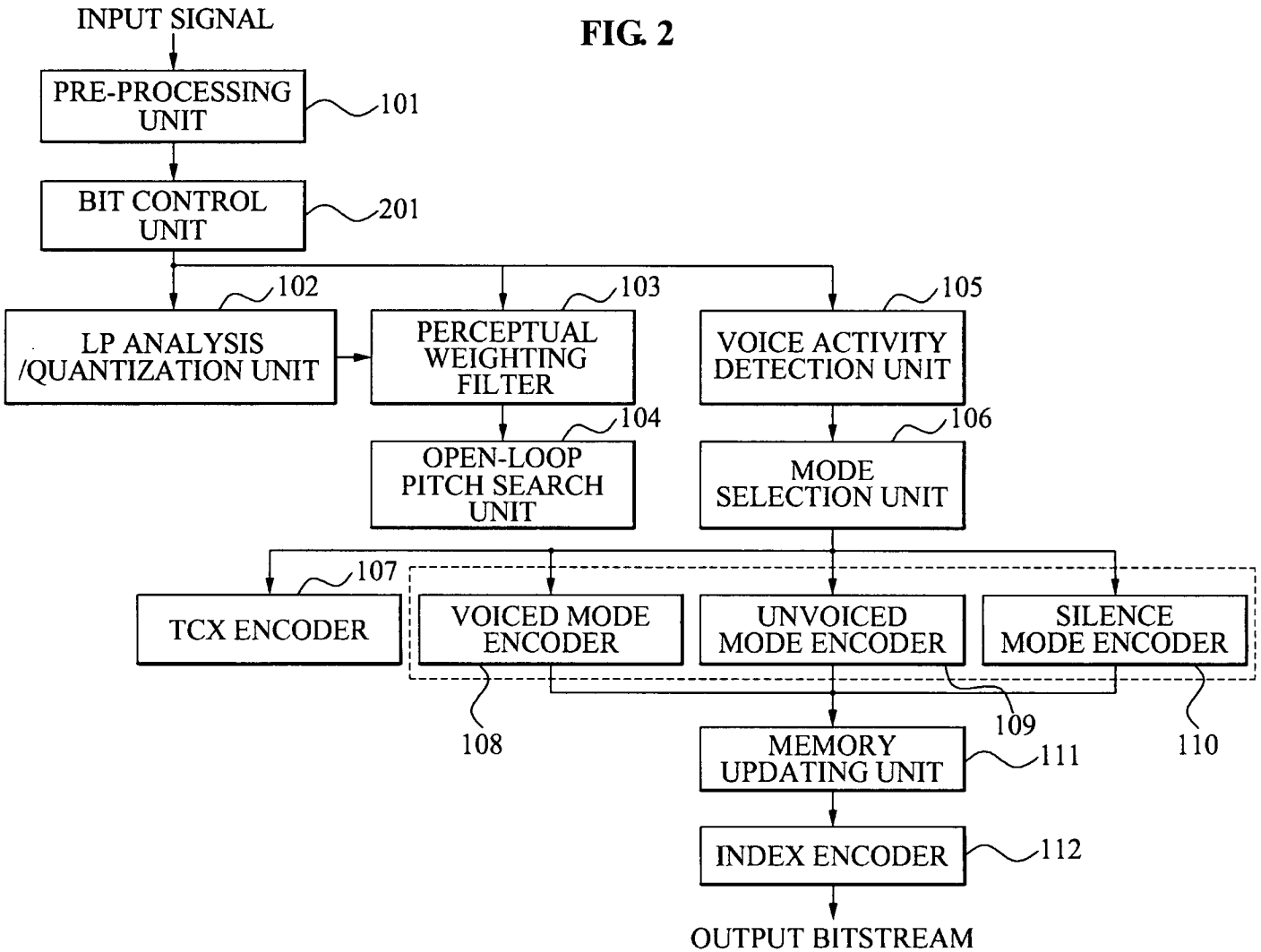
FIG. 2 illustrates a block diagram of an internal configuration of an encoding apparatus further including a bitrate control unit according to an exemplary embodiment.

FIG. 2 illustrates a block diagram of an internal configuration of an encoding apparatus further including a bitrate control unit 201 according to an exemplary embodiment. Referring to FIG. 2, the bitrate control unit 201 is further provided to the encoding apparatus of FIG. 1.

According to an exemplary embodiment, the encoding apparatus may verify a size of a reservoir of a currently used bit, and correct 'acelp_core_mode' that is pre-set prior to encoding, and thereby may apply a variable rate to encoding. The encoding apparatus may initially verify the size of the reservoir in a current frame and subsequently determine 'acelp_core_mode' according to a bitrate corresponding to the verified size. When the size of the reservoir is less than a reference value, the encoding apparatus may change 'acelp_core_mode' to a low bitrate. Conversely, when the size of the reservoir is less than the reference value, the encoding apparatus may change 'acelp_core_mode' to a high bitrate. When changing an encoding mode, a performance may be enhanced using various criteria. The above process may be applied once for each superframe and may also be applied to every frame. Criteria that may be used to change the encoding mode include the following:

One of the criteria is to apply a hysteresis to a finally selected 'acelp_core_mode'. In a case where the hysteresis is applied, when there is a need to increase 'acelp_core_mode', 'acelp_core_mode' may rise slowly. When there is a need to decrease 'acelp_core_mode', 'acelp_core_mode' may fall slowly. The criterion may be applicable when a different threshold for each mode change is used with respect to a case where 'acelp_core_mode' increases or decreases in comparison to a mode used in a previous frame. For example, when a bit of a reservoir that becomes a mode change reference is 'x', 'x+alpha' may become a threshold for the mode change in the case where there is a need to increase 'acelp_core_mode'. 'x−alpha' may become a threshold for the mode change in the case where there is a need to decrease 'acelp_core_mode'. The bitrate control unit 201 may be used to control the bitrate in the above criterion.

Generally, 'acelp_core_mode' has eight values and thus may be encoded in three bits. The same mode may be used within a superframe. The unvoiced mode and the silence mode may typically be used only at a low bitrate, for example, 12 kbps mono, 16 kbps mono, or 16 kbps stereo. An existing syntax may make a representation at a high bitrate. The unvoiced mode and the silence mode have a short duration and thus the encoding mode may be frequently changed within the superframe. The frame of the TCX mode may be encoded to suitable bits using eight values of 'acelp_core_mode'.

FIGS. 3 and 4, and FIGS. 6 through 10 illustrate examples for describing a syntax structure associated with a bitstream generated by an encoding apparatus according to an exemplary embodiment. Referring to the figures, frames included in a superframe may have the same encoding mode, or each of the frames may have a different encoding mode using a newly defined single bit of 'variable bit rate (VBR) flag'. Here, 'VBR flag' may have a value of '0' and '1'. 'VBR flag' having the value of '1' indicates that an unvoiced speech and a silence exist in the superframe. Specifically, when the unvoiced speech and the silence having a short duration exist in the superframe, a mode change may frequently occur within the superframe. Accordingly, when the unvoiced speech and the silence do not exist in the superframe using 'VBR flag', all the frames included in the superframe may be set to have the same encoding mode. Conversely, when the unvoiced speech and the silence do exist in the superframe, the encoding mode may be changed for each of the frames. FIG. 5 illustrates an example of a syntax according to FIG. 4.

Referring to FIG. 5, 'acelp_core_mode' may denote a bit field to indicate an accurate location of a bit like an Algebraic Code Excited Linear Prediction (ACELP) using Ipd encoding mode, and thus may indicate a common encoding mode of all the frames included in the superframe.

Also, 'Ipd_mode' may denote a bit field to define encoding modes of each of four frames within a single superframe of 'Ipd_channel_stream( )', corresponding to an advanced audio coding (AAC) frame, which will be described later. Here, the encoding modes may be stored as arranged 'mod[ ]' and may have a value between '0' and '3'. Mapping between 'Ipd_mode' and 'mod[ ]' may be determined by referring to the following Table 1:

TABLE 1

| | meaning of bits in bit-field mode | | | | | remaining mod[ ] |
|---|---|---|---|---|---|---|
| Ipd_mode | bit 4 | bit 3 | bit 2 | bit 1 | bit 0 | entries |
| 0 . . . 15 | 0 | mod[3] | mod[2] | mod[1] | mod[0] | |
| 16 . . . 19 | 1 | 0 | 0 | mod[3] | mod[2] | mod[1] = 2<br>mod[0] = 2 |
| 20 . . . 23 | 1 | 0 | 1 | mod[1] | mod[0] | mod[3] = 2<br>mod[2] = 2 |
| 24 | 1 | 1 | 0 | 0 | 0 | mod[3] = 2<br>mod[2] = 2<br>mod[1] = 2<br>mod[0] = 2 |
| 25 | 1 | 1 | 0 | 0 | 1 | mod[3] = 3<br>mod[2] = 3<br>mod[1] = 3<br>mod[0] = 3 |
| 26 . . . 31 | | | | | | reserved |

In the above Table 1, a value of 'mod[ ]' may indicate the encoding mode in each of the frames. The encoding mode according to the value of 'mod[ ]' may be determined as given by the following Table 2:

TABLE 2

| value of mod[x] | coding mode in frame | bitstream element |
|---|---|---|
| 0 | ACELP | acelp_coding( ) |
| 1 | one frame of TCX | tcx_coding( ) |
| 2 | TCX covering half a superframe | tcx_coding( ) |
| 3 | TCX covering entire superframe | tcx_coding( ) |

Figure 3:
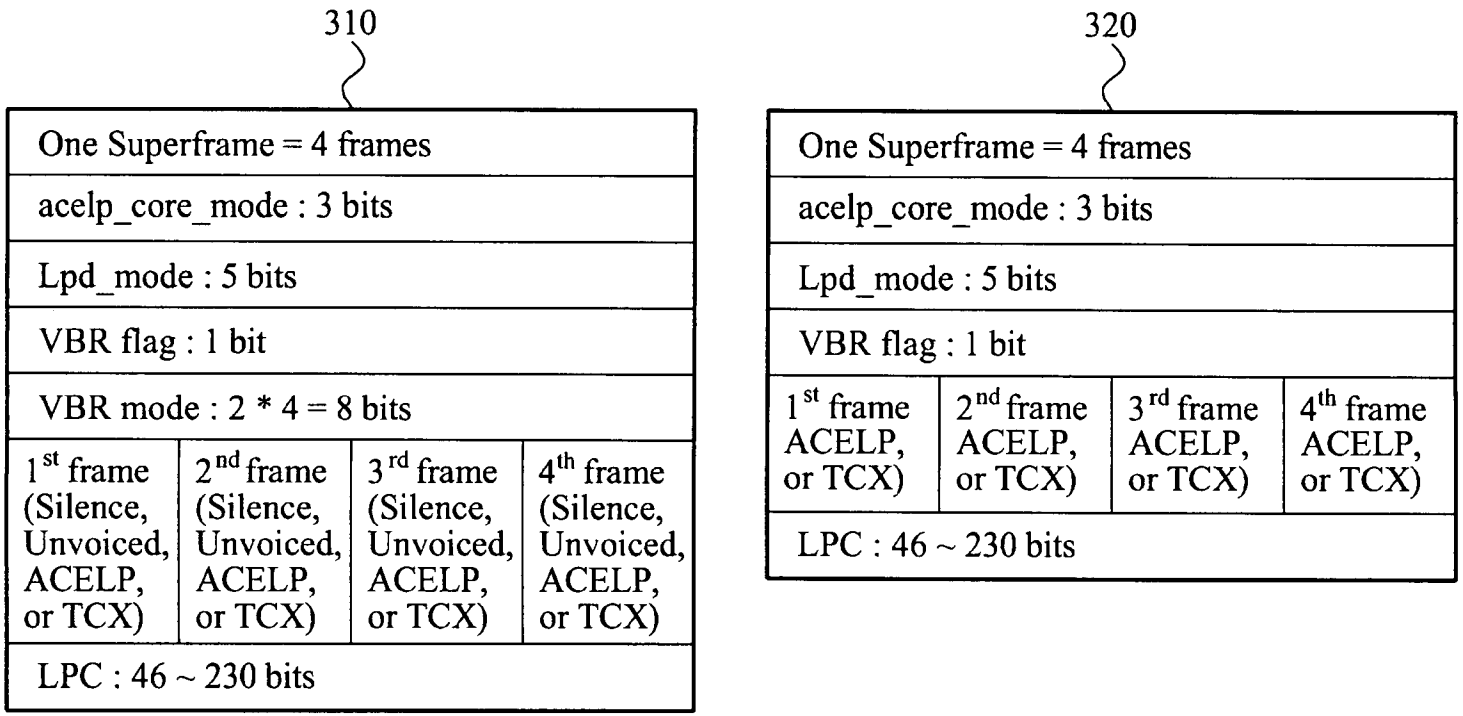
FIG. 3 illustrates tables for describing a syntax structure according to an exemplary embodiment.

FIG. 3 illustrates tables 310 and 320 for describing a syntax structure according to an exemplary embodiment. The table 310 shows a syntax structure where an unvoiced speech or a silence exists in a superframe, and the table 320 shows a syntax structure where the unvoiced speech or the silence does not exist in the superframe. In FIG. 3, a codec table dependent on 3 bits of 'acelp_core_mode' that may express eight modes may be used, and thus 'acelp_core_mode' may be corrected for each superframe. Specifically, when 'acelp_core_mode' is 0, 1, 2, and 3, encoding modes may be represented as 0 (silence), 1 (unvoiced), 2 (core mode), and 3

(core mode+1), respectively. When 'acelp_core_mode' is 4, 5, 6, and 7, the encoding modes may be represented as 0(core mode−1), 1(core mode), 2(core mode+1), and 3(core mode+2), respectively. Accordingly, a variable bitrate may be effectively applied. When it is assumed that a relative importance of the unvoiced speech and the silence occupies 20% in the input signal through an introduction of another encoding mode 'VBR mode' in addition to 'VBR flag' and 8 bits of the variable bitrate, "(9×0.2)+(1×0.8)=2.6" bits may be added to the superframe.

FIG. 4 illustrates tables 410 and 420 for describing a syntax structure according to another exemplary embodiment. Table 410 shows a syntax structure where an unvoiced speech or a silence exists in a superframe, and table 420 shows a syntax structure where the unvoiced speech or the silence does not exist in the superframe. In FIG. 4, an enumeration may be applied to three modes that may be output for each of the frames in a single superframe. Here, the three modes may include 0 (silence), 1 (unvoiced speech), and 2 (voiced speech and other signals). For example, "index=mode of first frame×27+mode of second frame×9+mode of third frame×3+mode of fourth frame" may be used with respect to the four frames. In this case, when it is assumed that 'UV mode' is 7 bits and a relative importance of the unvoiced speech and the silence occupies 20% in the input signal together with 1 bit of 'VBR flag', "(8×0.2)+(1×0.8)=2.4" bits may be added to the superframe. According to the aforementioned constraint, in a case where a frame of an unvoiced mode or a silence mode is followed by a frame of a voiced mode or a TCX mode, which is followed by another frame of the unvoiced mode or the silence mode, when the constraint of compulsorily changing the last frame of the unvoiced mode or the silence mode to the frame of the voiced mode or the TCX mode is applied, an order of the remaining three modes excluding the constraint from three modes that may be output for each frame may be represented using a 6-bit table. In this case, when it is assumed that the relative importance of the unvoiced speech and the silence occupies 20% in the input signal, "(7×0.2)+(1×0.8)=2.2" bits may be added to the superframe.

Referring again to FIG. 5, a solid box 510 indicates a syntax of 'Ipd_channel_stream( )'. 'Ipd_channel_stream( )' corresponds to the syntax to select an encoding mode with respect to the voiced mode and the TCX mode for each of the frames included in the superframe. Based on information that is added to the syntax and is indicated by a first dotted box 511 and a second dotted box 512, it can be known that encoding may be performed for each of the frames included in the superframe with respect to the unvoiced mode and the silence mode as well as with respect to the voiced mode and the TCX mode, using 'VBR_flag' and 'VBR_mode_index'.

FIG. 6 illustrates tables 610 and 620 for describing a syntax structure according to still another exemplary embodiment. Table 610 shows a syntax structure where an unvoiced speech or a silence exists in a superframe, and table 620 shows a syntax structure where the unvoiced speech or the silence does not exist in the superframe. In FIG. 6, available encoding modes are allocated based on 2 bits, and 'acelp_core_mode' is newly defined to 2 bits instead of 3 bits. The encoding mode may be selected using an internal sampling frequency (ISF) or an input bitrate. For an example of using the ISF, 9 (silence mode), 8 (unvoiced mode), 1, or 2 may be selected as the encoding mode with respect to ISF 12.8 (existing mode 1). 8 (unvoiced mode), 1, 2, or 3 may be selected as the encoding mode with respect to ISF 14.4 (existing mode 1 or 2). 2, 3, 4, or 5 may be selected as the encoding mode with respect to ISF 16 (existing mode 2 or 3). As an example of using the input bitrate, 9 (silence mode), 8 (unvoiced mode), 1, or 2 may be selected as the encoding mode with respect to 12 kbps mono (existing mode 1). 9 (silence mode), 8 (unvoiced mode), 1, or 2 may be selected as the encoding mode with respect to 16 kbps stereo (existing mode 1). 9 (silence mode), 8 (unvoiced mode), 2, or 3 may be selected as the encoding mode to 16 k mono (existing mode 2). When it is assumed that a relative importance of the unvoiced speech and the silence occupies 20% in the input signal by applying the unvoiced mode and the silence mode, "6×0.2=1.2" bits may be added to the superframe.

FIG. 7 illustrates tables 710 and 720 for describing a syntax structure according to yet another exemplary embodiment. Table 710 shows a syntax structure where an unvoiced speech or a silence exists in a superframe and an ISF is less than 16000 Hz, and table 720 shows a syntax structure where the unvoiced speech or the silence does not exist in the superframe and a bitrate is not changed in the superframe. In FIG. 7, 'VBR flag' is not used and a mode is shared according to the ISF. Here, when it is assumed that a relative importance of the unvoiced speech and the silence occupies 20% in the input signal by applying an unvoiced mode and a silence mode, "11×0.2=2.2" bit may be added to the superframe. No bit may be added with respect to a frame of a voiced mode and a frame of a TCX mode.

Figure 8:
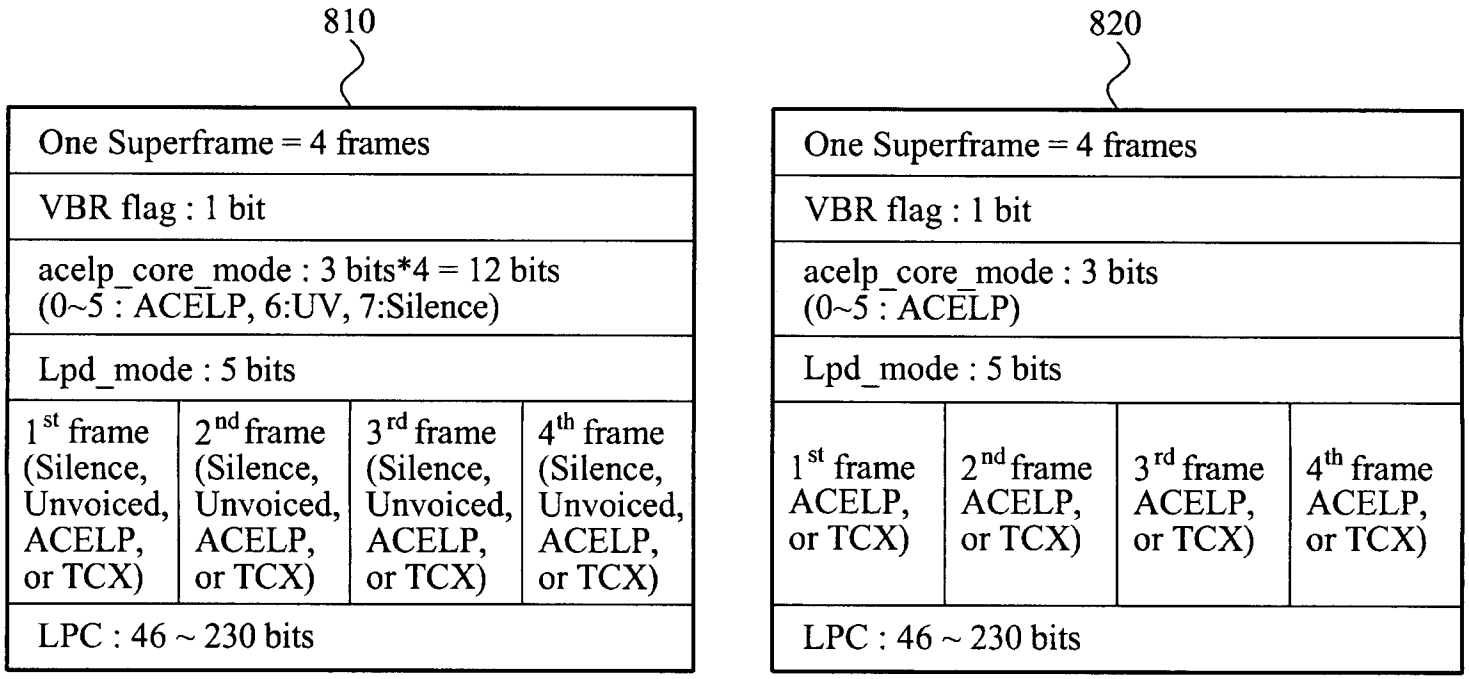
FIG. 8 illustrates tables for describing a syntax structure according to a further exemplary embodiment.

FIG. 8 illustrates tables 810 and 820 for describing a syntax structure according to a further exemplary embodiment. Table 810 shows a syntax structure where an unvoiced speech or a silence exists in a superframe and an ISF is less than 16000 Hz, and table 820 shows a syntax structure where the unvoiced speech or the silence does not exist and a bitrate is not changed in the superframe. In FIG. 8, all the encoding modes may be expressed in each frame by sharing modes 6 and 7 according to the ISF.

Figure 9:
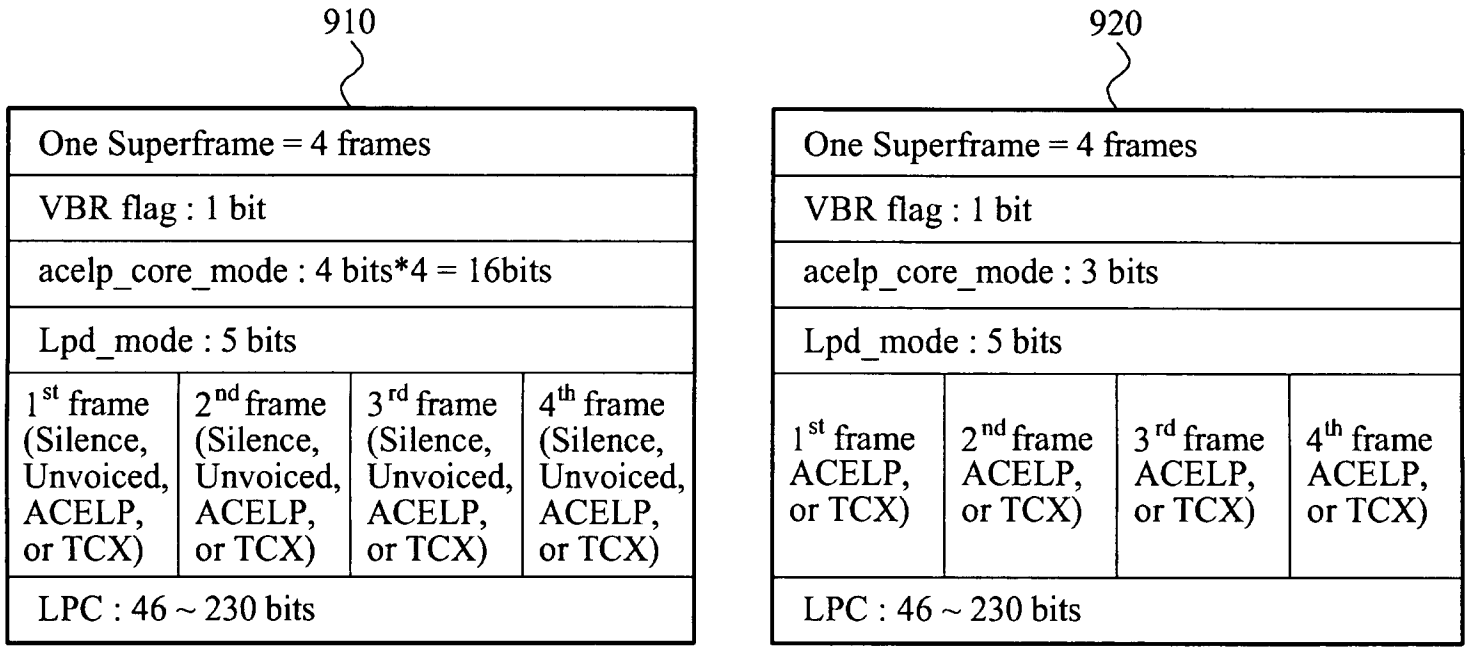
FIG. 9 illustrates tables for describing a syntax structure according to another exemplary embodiment.

FIG. 9 illustrates tables 910 and 920 for describing a syntax structure according to another exemplary embodiment. Table 910 shows a syntax structure where an unvoiced speech or a silence exists in a superframe, and table 920 shows a syntax structure where the unvoiced speech or the silence does not exist in the superframe. In FIG. 9, when a value of a voice activity detection (VAD) flag is '0', that is, when the superframe includes the unvoiced speech or the silence and an encoding mode of a frame included in the superframe is determined as an unvoiced mode or a silence mode, 'CELP mode' may be used at all times and otherwise, a CELP mode or a TCX mode may be used. When it is assumed that a relative importance of the unvoiced speech and the silence occupies 20% in the input signal, "((17−3)×0.2)+(1×0.8)=3.6" bits may be added to the superframe.

FIG. 10 illustrate tables 1010 and 1020 for describing a syntax structure according to another exemplary embodiment. Table 1010 shows a syntax structure where an unvoiced speech or a silence exists in a superframe, and table 1020 shows a syntax structure where the unvoiced speech or the silence does not exist in the superframe. In FIG. 10, indexing may be performed simply using VBR_flag. When it is assumed that a relative importance of the unvoiced speech and the silence occupies 20% in the input signal, "(9×0.2)+(1×0.8)=2.6" bits may be added to the superframe.

FIG. 11 illustrates an example of a syntax regarding a scheme to determine an encoding mode in interoperation with 'Ipd_mode' according to an exemplary embodiment. A solid box 1110 indicates a syntax of 'Ipd_channel_stream( )'. A first dotted box 1111 and a second dotted box 1112 indicate information added to the syntax of 'Ipd_channel_stream( )'. Specifically, FIG. 11 illustrates an example of a syntax regarding a scheme to reconfigure the entire modes by integrally using 5 bits of 'Ipd_mode', 3 bits of 'ACELP mode' ('acelp_core_mode'), and an added bit ('VBR_mode_index') for an unvoiced mode and a silence mode. For example, based on 256 samples, a frame having a TCX mode as a selected encoding mode may be verified using 'Ipd_mode'. Mode information of the verified frame may not be included in the superframe. Through this, it is possible to decrease a transmission bit (*a number of transmission bits in all the syntax structures excluding the syntax structures of FIG. 3. Based on 256 samples, a number of frames having the TCX mode as the selected encoding mode may be represented by 'no_of_TCX'. When four frames have the TCX mode as the selected encoding mode, 'VBR_flag' may become zero whereby no information may be added to the syntax.

Figure 12:
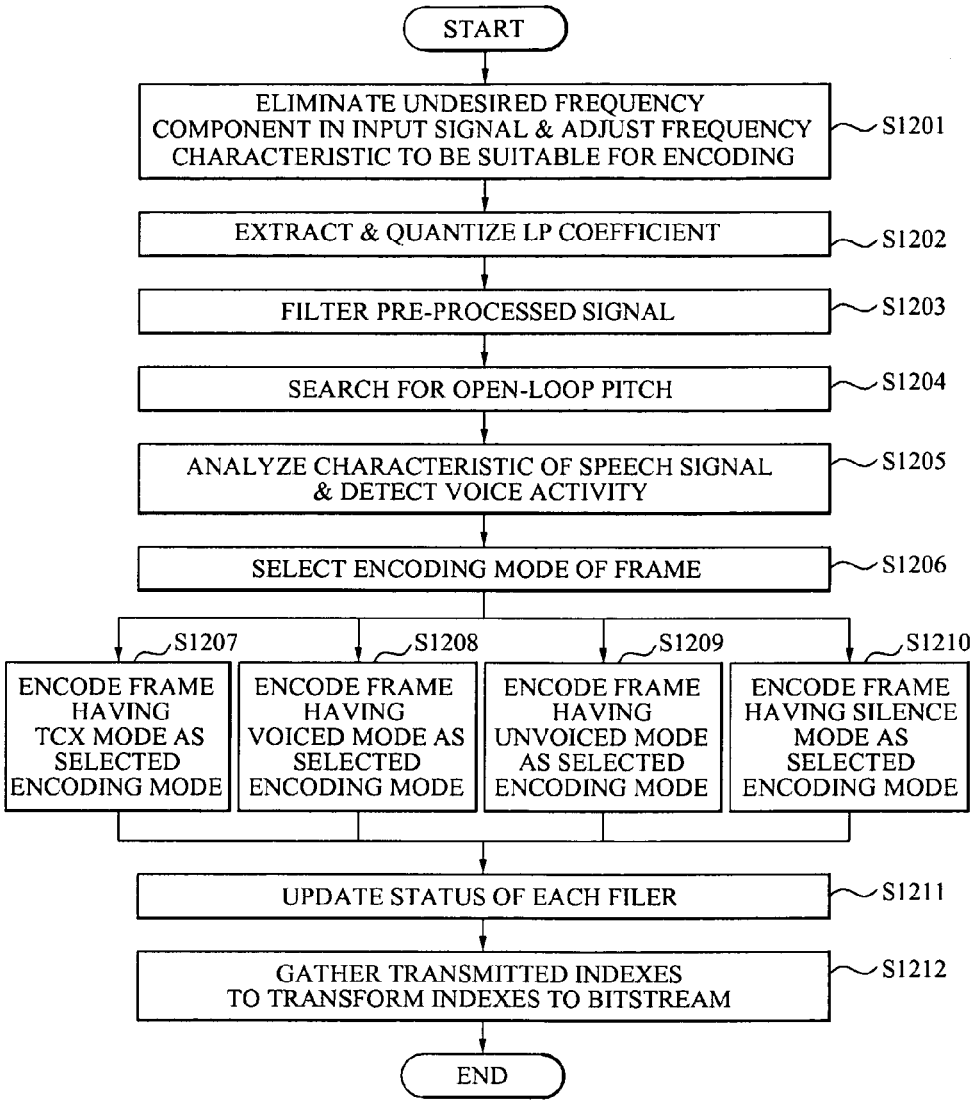
FIG. 12 illustrates a flowchart of an encoding method according to an exemplary embodiment.

FIG. 12 illustrates a flowchart of an encoding method according to an exemplary embodiment. The encoding method may be performed by the encoding apparatus of FIG. 1. Hereinafter, the encoding method will be described in detail with reference to FIG. 12.

A single superframe may include four frames. The single superframe may be encoded by encoding the four frames. For example, when a single superframe includes 1024 samples, each of the four frames may include 256 samples. Here, the frames may overlap each other to generate different frame sizes through an overlap and add (OLA) process.

In operation S1201, the encoding apparatus may eliminate an undesired frequency component in an input signal and may adjust a frequency characteristic to be suitable for an encoding through a pre-filtering operation. The encoding apparatus may use, for example, a pre-emphasis filtering of AMR-WB. The input signal may have a sampling frequency set to be for the encoding. For example, the input signal may have a sampling frequency of 8000 Hz in a narrowband speech encoder, and may have a sampling frequency of 16000 Hz in a wideband speech encoder. The input signal may have any sampling frequency that may be supported in the encoding apparatus. Here, down-sampling may occur outside a preprocessing unit and 12800 Hz may be used for an internal sampling frequency.

In operation S1202, the encoding apparatus may extract an LP coefficient using the filtered input signal. The encoding apparatus may convert the LP coefficient to a form suitable for a quantization, for example, to an ISF coefficient or an LSF frequency, and subsequently quantize the converted coefficient using various types of quantization schemes, for example, a vector quantizer.

In operation S1203, the encoding apparatus may filter a pre-processed signal via a cognitive weighted filter. Here, the encoding apparatus may decrease a quantization noise to be within a masking range in order to utilize a masking effect associated with a human hearing structure.

In operation S1204, the encoding apparatus may search for an open-loop pitch using the filtered signal.

In operation S1205, the encoding apparatus may receive the filtered signal, analyze a characteristic of the filtered signal, and detect a voice activity. As an example for a characteristic of the input signal, tilt information of a frequency domain, energy of each bark band, and the like may be analyzed.

In operation S1206, the encoding apparatus may select an encoding mode of a frame based on information regarding the open-loop pitch and the voice activity. Prior to selecting the encoding mode, the mode selection unit 106 may determine a property of a current frame. For example, the encoding apparatus may classify the property of the current frame into a voiced speech, an unvoiced speech, a silence, a background noise, and the like, using an unvoiced detection result. The encoding apparatus may determine the encoding mode of the current frame based on the classified result. In this instance, the encoding apparatus may select, as the encoding mode, one of a TCX mode, a voiced mode for a voiced speech, a background noise having great energy, a voice speech with background noise, and the like, an unvoiced mode, and a silence mode. Here, each of the TCX mode and the voiced mode may include at least one mode that has a different bitrate.

In operation S1207, the encoding apparatus may encode a frame having the TCX mode as the selected encoding mode. In operation S1208, the encoding apparatus may encode a frame having the voiced mode as the selected encoding mode. In operation S1209, the encoding apparatus may encode a frame having the unvoiced mode for the unvoiced speech as the selected encoding mode. In operation S1210, the encoding apparatus may encode a frame having the silence mode as the selected encoding mode.

When the TCX mode is selected as the encoding mode, the encoding mode having a size of 256 samples, 512 samples, and 1024 samples may be used. A total of six modes including the voiced mode, the unvoiced mode, and the silence mode may be used to select the encoding mode. Also, various types of schemes may be used to select the encoding mode.

Initially, the encoding mode may be selected using an open-loop scheme. The open-loop scheme may accurately determine a signal characteristic of a current interval using a module that verifies a characteristic of a signal, and may select the encoding mode most suitable for the signal. For example, when an interval of a current input signal is determined as a silence interval, the current input signal may be encoded using the silence mode. When the interval of the current input signal is determined as an unvoiced interval, the current input signal may be encoded using the unvoiced mode. Also, when the interval of the current input signal is determined as a voiced interval with background noise less than a predetermined threshold or as a voice interval without background noise, the current input signal may be encoded using the voiced mode. In other cases, the current input signal may be encoded using the TCX mode.

Second, the encoding mode may be selected using a closed-loop scheme. The closed-loop scheme may substantially encode the current input signal and select a most effective encoding mode using an SNR between the encoding signal and an original input signal, or another measurement value. In this instance, an encoding process may need to be performed with respect to all the available encoding modes. Accordingly, a complexity may increase whereas a performance may be enhanced. Also, when determining an appropriate encoder based on the SNR, determining whether to use the same bitrate or a different bit rate may become an issue. Since a bit utilization rate is basically different for each of the unvoiced mode and the silence mode, the most suitable encoding mode may need to be determined based on the SNR with respect to used bits. In addition, since each encoding scheme is different, a final selection may be made by appropriately applying a weight to each encoding scheme.

Third, the encoding mode may be selected by combining the aforementioned two encoding mode selection schemes. The third scheme may be used when the SNR between the encoded signal and the original input signal is low but the encoded signal frequently sounds similar to an original sound based on the original input signal. Accordingly, by combining the open-loop scheme and the closed-loop scheme, complexity may be decreased and the input signal may be encoded to have excellent sound quality. For example, when the interval of the current input signal is finally determined as a silence interval by searching for a case when the interval of the current input signal corresponds to the silence interval, the current input signal may be encoded using the silence mode. When the interval of the current input signal is determined as an unvoiced interval, the current input signal may be encoded using the unvoiced mode. Also, when the interval of the current input signal is determined as a background noise interval, the current input signal may be variously classified according to a signal characteristic. For example, when the input signal does not satisfy a criterion for the silence and the voiced speech, the input signal may be classified into the voiced signal and other signals. A background noise signal, a normal voiced signal, a voiced signal with the background noise, and the like may be encoded using the TCX mode and the voiced mode. Specifically, with particular reference to the TCX mode and the voiced mode, the input signal may be encoded using one of the open-loop scheme and a closed-loop scheme. An encoding technology adopting the open-loop scheme or the closed-loop scheme only with respect to the TCX mode and the voiced mode is well represented in an existing standardized AMR-WB+ encoder.

The encoding apparatus may perform a post-processing operation for the selected encoding mode. For example, as one of post-processing schemes, the encoding apparatus may assign a constraint to the selected encoding mode. The constraint scheme may eliminate an inappropriate combination of encoding modes that may affect a sound quality, and thereby enhance the sound quality of a finally encoded signal.

For example, when encoding each frame included in a superframe, a frame of the silence mode or the unvoiced mode may be followed by a single frame of the voiced mode or the TCX mode, which may be subsequently followed by another frame of the silence mode or the unvoiced mode. In this embodiment, the constraint scheme may compulsorily convert the last frame of the silence mode or the unvoiced mode to the frame of the voiced mode or the TCX mode by applying the constraint. When only a single frame of the voiced mode or the TCX mode exists, a mode may be changed even before appropriately performing encoding, which may affect the sound quality. Accordingly, the above constraint scheme may be used to avoid a short frame of the voiced mode or the TCX mode.

As another example of the constraint, there is a scheme that may temporarily correct the encoding mode when converting the encoding mode. For example, when a frame of the silence mode or the unvoiced mode is followed by a frame of the voiced mode or the TCX mode, a value corresponding to the encoding mode may temporarily increase with respect to the followed single frame regardless of 'acelp_core_mode', which will be described later. For example, it is assumed that encodable frame modes exist from mode 1 to mode 7 with respect to the frame of the voiced mode or the TCX mode. When 'acelp_core_mode' representing a mode of a current frame is mode 1 and corresponds to the above criterion, one of the current mode and mode 1 to mode 6 may be selected as a final mode of the current frame.

As still another example of the constraint, there is a scheme that may enable the frame of the silence mode or the unvoiced mode to be activated primarily at a low bitrate. For some embodiments, a sound quality may be more important than a bitrate being greater than a given bitrate. In this case, the third constraint may be minus for the entire sound quality at a very high bitrate. Accordingly, in an embodiment, encoding may be performed using only the frame of the voiced mode or the TCX mode. In this instance, a criterion may be appropriately selected by the developer. For example, when encoding is performed at less than 300 bits per frame including 256 samples, the encoding may be performed using the frame of the silence mode or the unvoiced mode. When encoding is performed at greater than 300 bits per frame, the encoding may be performed using only the frame of the voiced mode or the TCX mode.

As still another example of a constraint, there is a scheme that may verify a characteristic of a current frame and correct the encoding mode. Specifically, when the current frame is determined as the frame of the voiced mode or the TCX mode, but the current frame is has a low periodicity like onset or a transition, encoding of the frame may affect an after-performance. Accordingly, the current frame may be temporarily encoded at a high bitrate regardless of 'acelp_core_mode'. For example, let encodable frame modes exist from mode 1 to mode 7 with respect to the frame of the voiced mode or the TCX mode. When 'aceip_core_mode' of the current frame is mode 1 and corresponds to the above criterion, that is, the onset or the transition, one of the current mode+mode 1 to mode 6 may be selected as a final mode of the current frame.

In operation S1211, the encoding apparatus may update a status of each filter used for encoding. In operation S1212, the encoding apparatus may gather transmitted indexes to transform the indexes to a bitstream, and then may store the bitstream in a storage unit or may transmit the bitstream via a channel.

The encoding method according to the above-described embodiments may be recorded in computer-readable media including program instructions to implement various operations embodied by a computer. The media may also include, alone or in combination with the program instructions, data files, data structures, and the like. Examples of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as code produced by a compiler, and files containing higher level code that may be executed by the computer using an interpreter. The described hardware devices may also be configured to act as one or more software modules in order to perform the operations of the above-described embodiments, or vice versa. The encoding method may be executed on a general purpose computer or may be executed on a particular machine such as an encoding apparatus or the encoding apparatus of FIG. 1.

Figure 13:
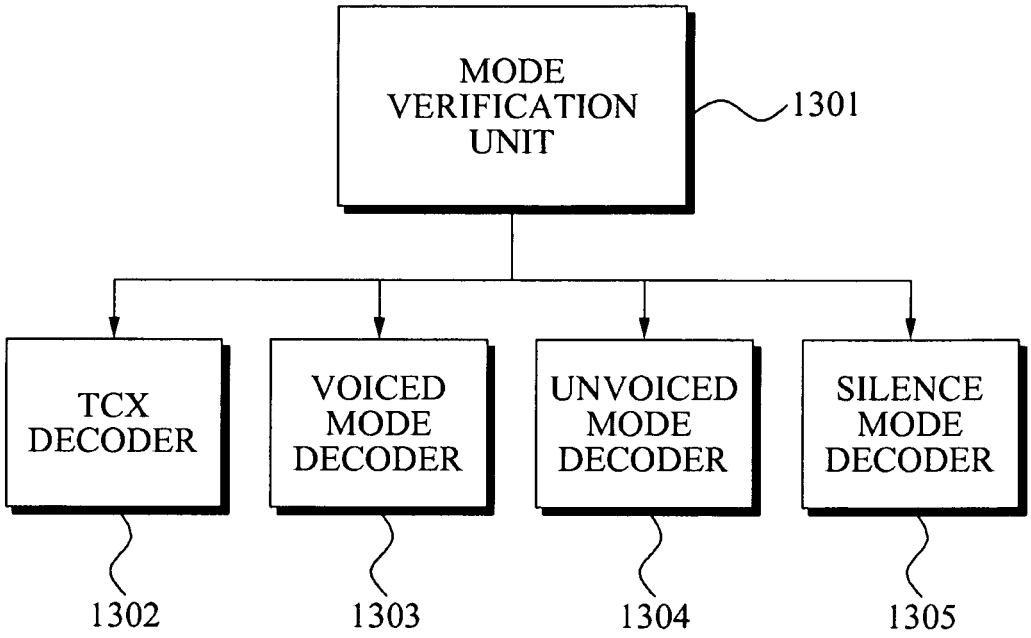
FIG. 13 illustrates a block diagram of an internal configuration of a decoding apparatus according to an exemplary embodiment.

FIG. 13 illustrates a block diagram of an internal configuration of a decoding apparatus according to an exemplary embodiment. Referring to FIG. 13, the decoding apparatus may include a mode verification unit 1301, a TCX encoder 1302, a voiced mode decoder 1303, an unvoiced mode decoder 1304, and a silence mode decoder 1305.

The mode verification unit 1301 may verify an encoding mode of a frame in an input bitstream. The encoding mode may include an unvoiced mode, a silence mode for a silence, a voiced mode for a voiced speech and a background noise, and a TCX mode.

The TCX decoder 1302 may decode a frame having the TCX mode as the selected encoding mode. The voiced mode decoder 1303 may decode a frame having the voiced mode as the selected encoding mode. The unvoiced mode decoder 1304 may decode a frame having the unvoiced mode for an unvoiced speech as the selected encoding mode. The silence mode decoder 1305 may decode a frame having the silence mode as the selected encoding mode.

When none of the unvoiced speech and a silence are detected in a superframe including a plurality of frames, the same encoding mode may be selected for all the frames included in the superframe. When at least one of the unvoiced speech and the silence is detected in the superframe, the encoding mode may be individually selected for each of the frames included in the superframe.

As described above, according to an exemplary embodiment, it is possible to encode a frame that includes an unvoiced speech, using an unvoiced mode in a superframe structure. Also, it is possible to determine an encoding mode of each frame, classified into an unvoiced speech, a voiced speech, a silence, and a background noise, as a voiced mode, an unvoiced mode, or a TCX mode, and to encode each of the frames at a different bitrate using an encoder corresponding to each of the voiced mode, the unvoiced mode, and the TCX mode.

Although a few exemplary embodiments have been shown and described, it would be appreciated by those skilled in the art that changes may be made in these exemplary embodiments without departing from the principles and spirit of the disclosure, the scope of which is defined by the claims and their equivalents.

What is claimed is:

1. An apparatus including a processor having computing device-executable instructions, the apparatus comprising:

a mode selection unit, controlled by the processor, to select an encoding mode for each of the frames in a speech signal, based on characteristics of the speech signal comprising of a voice activity;

a Transform Coded eXcitation (TCX) encoder to encode the speech signal selected as a TCX mode by the mode selection unit; and a Code Excited Linear Prediction (CELP) encoder to encode the speech signal selected as a CELP mode by the mode selection unit, wherein the CELP mode comprises an unvoiced mode and a voiced mode.

2. The encoding apparatus of claim 1, wherein when neither of an unvoiced speech and a silence are detected in a superframe including a plurality of frames, the mode selection unit selects the same encoding mode for all the frames included in the superframe, and when at least one of the unvoiced speech and the silence is detected in the superframe, the mode selection unit individually selects an encoding mode that corresponds to each frame, for each of the frames included in the superframe.

3. The encoding apparatus of claim 2, wherein a predetermined flag is inserted into the superframe to indicate whether at least one of the unvoiced speech and the silence is included in the superframe.

4. The encoding apparatus of claim 3, wherein the encoding mode of each of the frames included in the superframe is determined based on the predetermined flag and an Algebraic Code Excited Linear Prediction (ACELP) core mode that indicates a common encoding mode of all the frames included in the superframe.

5. The encoding apparatus of claim 3, wherein the encoding mode of each of the frames included in the superframe is determined based on the predetermined flag and an index where an enumeration is applied with respect to an encoding mode for outputting for each of the frames included in the superframe.

6. The encoding apparatus of claim 1, wherein the encoding mode further includes a silence mode for the silence, and the CELP encoder comprises:

a voiced mode encoder to encode a frame having the voiced mode as the selected encoding mode;

a silence mode encoder to encode a frame having the silence mode as the selected encoding mode; and an unvoiced mode encoder to encode a frame having the unvoiced mode as the selected encoding mode.

7. The encoding apparatus of claim 6, wherein the encoding mode for the frame of the unvoiced mode and the frame of the silence mode is selected using an open-loop scheme, and the encoding mode for the frame of the voiced mode and the frame of the TCX mode is selected using a closed-loop scheme.

8. The encoding apparatus of claim 1, further comprising:

a voice activity detection unit to transmit, to the mode selection unit, information that is obtained by analyzing a characteristic of the speech signal and detecting the voice activity; and an open-loop pitch search unit to retrieve an open-loop pitch and to transmit the open-loop pitch to the mode selection unit.

9. The encoding apparatus of claiml, wherein the mode selection unit determines a property of a current frame based on information including the voice activity to select the encoding mode of the current frame as one of a plurality of modes comprising the TCX mode, the voiced mode, and the unvoiced mode, based on the property of the current frame.

10. The encoding apparatus of claim 9, wherein the TCX mode includes a plurality of modes that are pre-determined based on a frame size.

11. A decoding apparatus including a processor having computing device-executable instructions, the apparatus comprising:

an encoding mode verification unit, controlled by the processor, to verify an encoding mode for each of frames in a bitstream, wherein the encoding mode has been determined based on characteristics of the speech signal comprising a voice activity;

a TCX decoder to decode the speech signal verified as a TCX mode by the encoding mode verification unit; and a CELP decoder to decode the speech signal verified as a CELP mode by the encoding mode verification unit, wherein the CELP mode comprises an unvoiced mode and a voiced mode.

12. The decoding apparatus of claim 11, wherein the encoding mode further includes a silence mode for a silence, and the CELP decoder comprises:

a voiced mode decoder to decode a frame having the voiced mode as the selected encoding mode;

a silence mode decoder to decode a frame having the silence mode as the selected encoding mode; and an unvoiced mode decoder to decode a frame having the unvoiced mode as the selected encoding mode.

13. The decoding apparatus of claim 11, wherein when none of an unvoiced speech and a silence are detected in a superframe including a plurality of frames, the same encoding mode is selected for all the frames included in the superframe, and when at least one of the unvoiced speech and the silence is detected in the superframe, the encoding mode is individually selected for each of the frames included in the superframe.

14. An encoding method comprising:

selecting an encoding mode for each of the frames in a speech signal, based on characteristics of the speech signal comprising voice activity;

TCX-encoding, using a processor, the speech signal selected as a TCX mode according to the selection result; and CELP-encoding the speech signal selected as a CELP mode according to the selection result, wherein the CELP mode comprises an unvoiced mode and a voiced mode.

15. The encoding method of claim 14, wherein the selecting comprises selecting the same encoding mode for all the frames included in a superframe, when neither of an unvoiced speech and a silence are detected in the superframe including the frames, and individually selecting an encoding mode that corresponds to each frame, for each of the frames included in the superframe when at least one of the unvoiced speech and the silence is detected in the superframe.

16. The encoding method of claim 15, wherein a predetermined flag is inserted into the superframe to indicate whether at least one of the unvoiced speech and the silence is included in the superframe.

17. The encoding method of claim 16, wherein the encoding mode of each of the frames included in the superframe is determined based on the predetermined flag and an ACELP core mode that indicates a common encoding mode of all the frames included in the superframe.

18. The encoding method of claim 16, wherein the encoding mode of each of the frames included in the superframe is determined based on the predetermined flag and an index where enumeration is applied with respect to an encoding mode for outputting for each of the frames included in the superframe.

19. The encoding method of claim 14, wherein the encoding mode further includes, a silence mode for the silence, and the CELP-encoding method comprises:

encoding a frame having the voiced mode as the selected encoding mode;

encoding a frame having the silence mode as the selected encoding mode; and encoding a frame having the unvoiced mode as the selected encoding mode.

20. The encoding method of claim 14, wherein the selecting comprises determining a property of a current frame based on information including the voice activity and, and selecting the encoding mode of the current frame as one of a plurality of modes comprising theTCX mode, the voiced mode, and the unvoiced mode, based on the property of the current frame.

* * * * *